US005944960A

United States Patent [19]

Nakata et al.

[11] Patent Number: 5,944,960

[45] Date of Patent: Aug. 31, 1999

[54] CARBONIZING FURNACE

[75] Inventors: Kunii Nakata; Tsutomu Abe, both of Nagano, Japan

[73] Assignees: Kabushiki Kaisha Nakata Giken; Kabushiki Kaisha Yasuda Seisakusho, both of Nagano-ken, Japan

[21] Appl. No.: 09/056,092

[22] Filed: Apr. 7, 1998

[51] Int. Cl.[6] ..... C10B 1/10; C10B 21/12

[52] U.S. Cl. ..... 202/100; 110/214; 110/246; 110/257; 202/113; 202/117; 202/216; 427/450; 432/106; 432/109

[58] Field of Search ..... 202/100.117, 216, 202/113, 265, 118; 201/27, 31, 32, 33, 38, 26; 48/111; 110/210–211, 214, 246, 257; 432/109–110, 117, 105, 106, 143; 34/137, 141; 427/450; 422/154, 150

[56] References Cited

U.S. PATENT DOCUMENTS 4,179,263 12/1979 Jung et al. ..... 432/1
4,272,322 6/1981 Kobayashi ..... 201/6
4,734,166 3/1988 Angelo, II ..... 202/100
4,814,145 3/1989 Yoshida et al. ..... 422/150

FOREIGN PATENT DOCUMENTS 08208209 8/1996 Japan .

*Primary Examiner*—Virginia Manoharan
*Attorney, Agent, or Firm*—Birch, Stewart, Kolasch & Birch, LLP

[57] ABSTRACT

The carbonizing furnace of the present invention is capable of effectively making a large amount of carbides and reducing manufacturing cost and maintenance cost. The carbonizing furnace includes a furnace proper being formed into a cylindrical shape, the furnace proper having a first end section, to which a combustible raw material is supplied, and a second end section, from which a carbide is discharged; a spiral member for conveying the raw material from the first end section to the second end thereof; and a burner for burning the raw material to make the carbide, the burner burns the raw material in the second end section whereby the raw material is carbonized therein, wherein a surface of the raw material is coated with an inorganic binder.

19 Claims, 5 Drawing Sheets

CARBONIZING FURNACE

BACKGROUND OF THE INVENTION

1. Field of the Invention

The present invention relates to a carbonizing furnace for carbonizing combustibles.

2. Description of the Background Art

Conventionally, in the case of charcoal making, for example, combustible raw materials are accommodated in a closed charcoal kiln. In the charcoal kiln, gas elements of the raw materials are removed by burning. In a closed carbonizing furnace, the amount of oxygen is limited, so that carbides can be prevented from over burning and forming into ash. Further, the temperature in the furnace can be maintained at a high level, so the gas elements can be removed from the hearts of the raw materials. Thus the carbides can be made efficiently.

The inventor invented a method of making a carbide (Japanese Patent Kokai Gazette No. 8-208209), in which a combustible raw material can be carbonized in an oxidizing atmosphere without burning out if the surface of the raw material is coated with an inorganic binder, e.g. bentonite. The inventor supposes that the oxidization of the raw material is limited by the inorganic binder. In the case of coating the raw material with the inorganic binder and a water-soluble sugar, the oxidization is more effectively limited. To coat the surface of the raw material, the inorganic binder and the water-soluble sugar may be mixed with water.

The conventional closed carbonizing furnace is effective for carbonizing bigger materials, e.g., wood. However, it takes a long time to carbonize them because the materials must be accommodate in the furnace. Therefore, the conventional closed carbonizing furnace cannot be employed for industrial use or mass production. Further, the temperature in the furnace must be high because the gas elements are burnt out therein, so the inner walls of the furnace must be formed with heat-resisting materials, e.g., ceramics. By employing the heat-resisting materials, manufacturing cost and maintenance cost of the furnace are increased.

SUMMARY OF THE INVENTION

An object of the present invention is to provide a carbonizing furnace which is capable of effectively making a large amount of carbides.

Another object of the present invention is to provide a carbonizing furnace whose manufacturing cost and maintenance cost can be reduced.

To achieve the objects, the carbonizing furnace of the present invention comprises:

- a furnace proper being formed into a cylindrical shape, the furnace proper having a first end section, to which a combustible raw material is supplied, and a second end section, from which a carbide is discharged;
- means for conveying the raw material from the first end section to the second end thereof; and
- means for burning the raw material to make the carbide, the burning means burning the raw material in the second end section whereby the raw material is carbonized therein,
  - wherein a surface of the raw material is coated with an inorganic binder.

In the carbonizing furnace of the present invention, the raw material can be carbonized efficiently, so the carbonizing furnace can be employed for the industrial use.

In the carbonizing furnace, the conveying means may include:

- a rotating mechanism for rotating the furnace proper about its axial line; and
- a spiral member being provided in the furnace proper, the spiral member being capable of conveying the raw material from the first end section to the second end section. With this structure, the raw material can be properly conveyed, in the furnace proper, from the first end section toward the second end section.

In the carbonizing furnace, the burning means may be a burner, which is provided in the second end section and capable of throwing a flame into the second end section of the furnace proper toward the first end section thereof. With this structure, gas elements in the raw material can be removed by burning and the raw material can be properly carbonized.

In the carbonizing furnace, the furnace proper may be formed by connecting a plurality of sub-furnace members in the axial direction of the furnace proper. With this structure, the manufacturing cost and the maintenance cost of the furnace can be reduced.

In the carbonizing furnace, the furnace proper may comprise:

- a metallic inner cylindrical member;
- a metallic outer cylindrical member whose diameter is greater than that of the inner cylindrical member, the outer cylindrical member being coaxially provided outside of the inner cylindrical member; and
- a heat insulating layer being formed between the inner cylindrical member and the outer cylindrical member. With this structure, the furnace can be manufactured easily.

In the carbonizing furnace, one end of the inner cylindrical member may be fixed to the outer cylindrical member, wherein the other end of the inner cylindrical member is not fixed so as to allow heat expansion of the inner cylindrical member. With this structure, problems caused by the heat expansion can be solved, so that the span of life of the carbonizing furnace can be longer.

In the carbonizing furnace, the spiral member may be a spiral-formed belt which is fixed on an inner circumferential face of the furnace proper whereby a hollow conveying path, which is extended in the axial line of the furnace proper, is formed in the furnace proper, and

- means for lifting the raw material may be provided between each couple of faces of the spiral-formed belt, which face each other in each pitch of the spiral, in the first end section of the furnace proper. With this structure, the raw material can be properly conveyed and carbonized.

In the carbonizing furnace, the lifting means may be a plate member provided parallel to the axial line of the furnace proper. With this structure, the raw material can be conveyed stably.

In the carbonizing furnace, the raw material may be supplied to a position in the furnace proper, which is one pitch or more inside from an end of the spiral-formed belt. With this structure, the raw material can be conveyed securely.

The carbonizing furnace may further comprise means for sucking gas, which is generated when the raw material is carbonized. With this structure, carbonizing the raw material can be accelerated and the gas can be securely discharged.

The carbonizing furnace may further comprise:

- a gas discharging path through which gas, which is generated when the raw material is carbonized, is discharged; and means for collecting wood vinegar, the collecting means being provided in the gas discharging path, the collecting means being capable of cooling the evaporated wood vinegar to collect the wood vinegar as a liquid. With this structure, the liquid of the wood vinegar can be collected.

BRIEF DESCRIPTION OF THE DRAWINGS

Embodiments of the present invention will now be described by way of examples and with reference to the accompanying drawings, in which.

DETAILED DESCRIPTION OF THE PREFERRED EMBODIMENTS

Preferred embodiments of the present invention will now be described in detail with reference to the accompanying drawings.

First Embodiment

Figure 1:
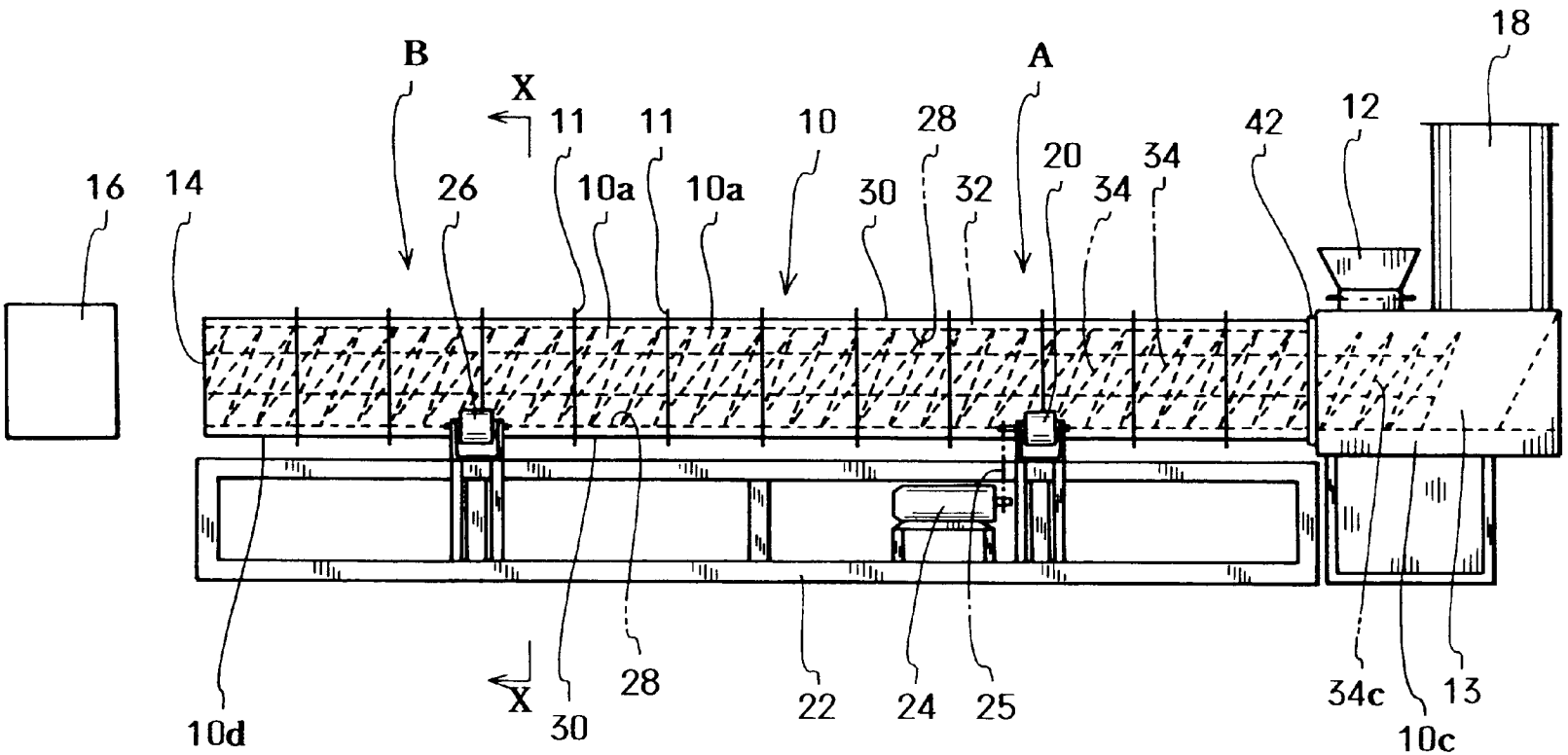
FIG. 1 is a side view of the carbonizing furnace of a First Embodiment of the present invention.
Figure 2:
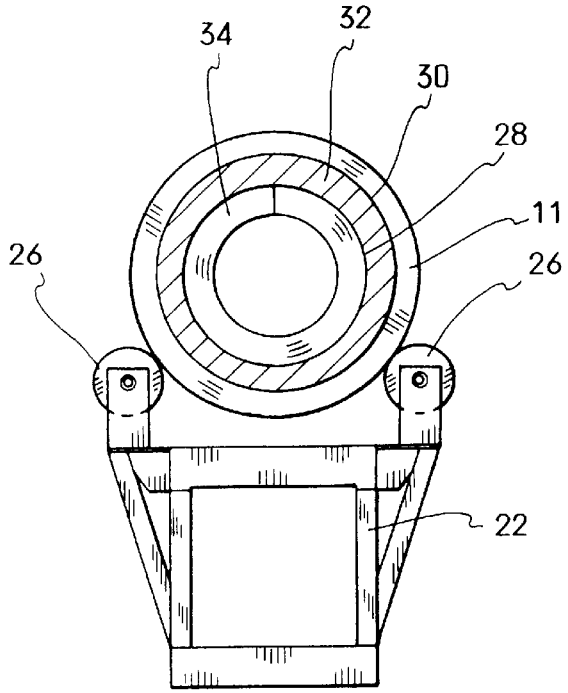
FIG. 2 is a sectional view taken along a line X—X in FIG. 1.
Figure 3:
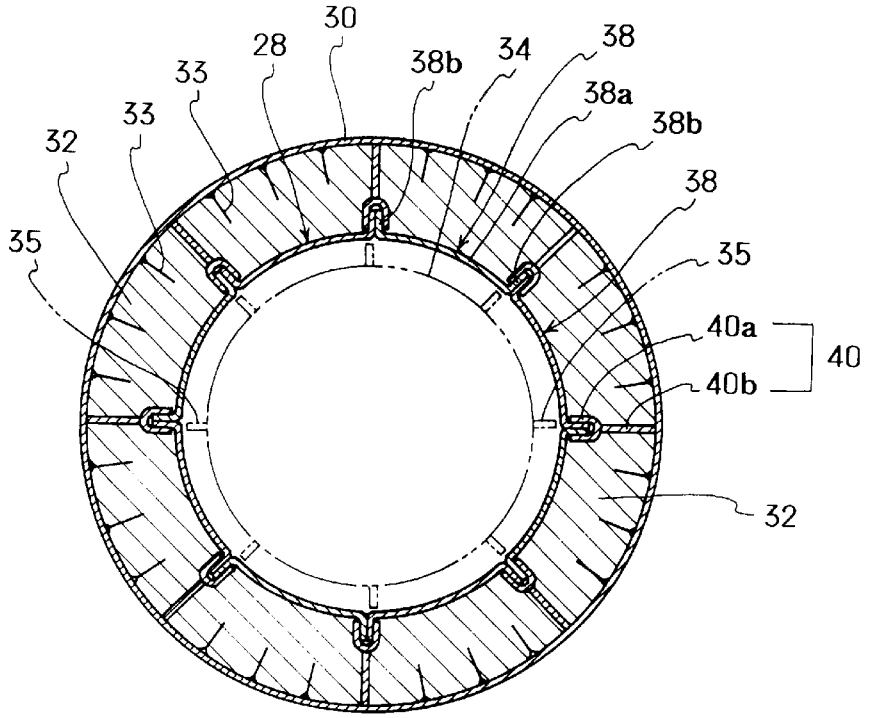
FIG. 3 is a sectional view of a furnace proper.

First Embodiment will be explained with reference to FIGS. 1–3: FIG. 1 is a side view of the carbonizing furnace of the First Embodiment; FIG. 2 is a sectional view taken along a line X—X in FIG. 1; and FIG. 3 is a sectional view of a furnace proper.

A furnace proper 10 is formed into a cylindrical shape. The furnace proper 10 has a first end section 10*c*, to which combustible raw materials are supplied, and a second end section 10*d*, from which carbides, which are made by carbonizing the raw materials, are discharged. Unlike the conventional closed furnace, both ends of the furnace proper 10 are opened, namely the carbonizing furnace of the present embodiment is an open-type furnace. With this structure, the raw materials can be continuously and efficiently carbonized. The raw materials are made from combustibles or include combustibles. Surfaces of the raw materials are coated with an inorganic binder. In the present embodiment, the raw materials are formed into a granular shape. By forming the raw materials into the granular shape, the raw materials can be easily conveyed in the furnace proper 10.

The furnace proper 10 includes a plurality of sub-furnace members 10*a*. The sub-furnace members 10*a* are linearly connected in the axial direction of the furnace proper 10. They are detachably connected one another. There are formed flanges 11 at each end of each sub-furnace member 10*a*. The flanges 11 of adjacent sub-furnace members 10*a* are connected by bolts, etc. With this structure, the furnace proper 10 is formed into a long cylindrical shape. By detachably connecting the sub-furnace members 10*a*, the furnace proper 10 can be easily formed and maintenance can be easily executed. The sub-furnace member 10*a* which is apt to be damaged by high temperature can be exchangeable.

If the long furnace proper 10 is made of one long cylindrical member, it is apt to be transformed, so it is very difficult to make. Further, it must be difficult to execute cleaning and maintenance.

The cylindrical furnace proper 10 has: a drying section "A" in which the raw materials are dried; and a carbonizing section "B" in which the dried materials are carbonized. The raw materials are conveyed, in the furnace proper 10, from an entrance 12 (the first end section 10*c*) toward an exit 14 (the second end section 10*d*) by conveying means (explained later). The raw materials are dried in the drying section "A", which is located near the entrance 12; the dried materials are started to burn in a center part of the furnace proper 10; gas elements in the raw materials are burnt out until reaching the exit 14; the carbonized materials (the carbides) are finally discharged from the exit 14.

By using the carbonizing furnace of the present embodiment, the granular raw materials can be continuously conveyed in the furnace proper 10; the carbides can be continuously made, so a large amount of the carbides can be efficiently made.

A burner 16 is provided to face the exit 14 of the furnace proper 10. The burner 16 is capable of throwing a flame into the furnace proper 10 via the exit 14. The flame of the burner 16 mainly burns out the gas elements in the raw materials. Heated air, which is heated by the burner 16, flows, in the furnace proper 10, from the exit 14 toward the first end section 10*c*. The flowing direction of the heated air is the opposite direction to the material conveying direction. By flowing the heated dry air in the furnace proper 10, the raw materials which are continuously conveyed can be properly dried. The heat, which is generated by burning the gas in the raw materials, can be effectively used. Even if the raw materials include water or moisture, the raw materials can be dried, so that they can be efficiently carbonized. In the case of carbonizing dry materials, e.g., rice hull, the drying section "A" may be shorter.

A chimney 18 exhausts exhaust gas. To remove an odor which is generated when the raw materials are dried, an after burner may be provided to the chimney 18.

The entrance 12 is formed into a hopper-shape so as to easily supply the raw materials into the furnace proper 10.

Driving rollers 20 are rotatably provided to a base 22. The driving rollers 20 are rotated by a motor 24 and a chain mechanism 25. Outer circumferential faces of the driving rollers 20 contact outer circumferential faces of the flanges 11 of the sub-furnace members 10*a* of the furnace proper 10 so as to support the furnace proper 10. By rotating the driving rollers 20, the furnace proper 10 is rotated about its own axis.

Free rollers 26 are rotatably provided to the base 22. As shown in FIG. 2, the free rollers 26 rotatably support the furnace proper 10. When the driving rollers 20 are rotated by the motor 24, the furnace proper 10 is rotated and the free rollers 26 are rotated together with the furnace proper 10. Note that, a rotating mechanism for rotating the furnace proper 10 is not limited to above described mechanism. Many types of mechanisms, e.g., gear mechanisms, belt mechanisms, may be employed as the rotating mechanism.

Next, the furnace proper 10 will be explained.

The furnace proper 10 comprises: a metallic inner cylindrical member 28; a metallic outer cylindrical member 30 whose diameter is greater than that of the inner cylindrical member 28, and which is coaxially provided outside of the inner cylindrical member 28; and a heat insulating layer 32 which is formed between the inner cylindrical member 28 and the outer cylindrical member 30. The inner cylindrical member 28 and the outer cylindrical member 30 are made of a metal having proper heat-resisting property and corrosion-resisting property, e.g., stainless steel.

In the present embodiment, the insulating layer 32 is made from ceramic fibers which are bound with an adhesive. The metallic inner cylindrical member 28 has high heat radiativity, so it is difficult to maintain high temperature. Thus the insulating layer 32 is formed to keep the temperature of the inner cylindrical member 28. Note that, the outer cylindrical member 30 may be covered with another insulating layer so as to effectively maintain the temperature of the furnace proper 10.

As shown in FIG. 3, pins 33 project inwardly from an inner circumferential face of the outer cylindrical member 30 so as to fix the insulating layer 32. The pins 33 are fixed on the inner circumferential face of the outer cylindrical member 30 by stud-welding, etc. The insulating layer 32 is expanded and shrunk because of changing temperature; the insulating layer 32 moves in the axial direction if no pins 33 are provided.

A plurality of spiral members (spiral-formed belts) 34 (see FIG. 5) are fixed on an inner circumferential face of the inner cylindrical member 28. Namely, each spiral member 34 is fixed on the inner circumferential face of the inner member of each sub-furnace member 10*a*. The spiral members 34 are capable of conveying the raw materials from the entrance 12 to the exit 14. The linear length of each spiral member 34 is almost equal to the length of each sub-furnace member 10*a*. The spiral members 34 are also mutually connected in the axial direction of the furnace proper 10. In some cases, the adjacent spiral members 34 are not connected to each other when the adjacent sub-furnace members 10*a* are connected. If screwing directions of the adjacent spiral members 34 are the same, the raw materials can be correctly conveyed by the rotation of the furnace proper 10 even if the adjacent spiral members 34 are not connected.

The spiral members 34, which are located in the drying section "A" and the section in which the gas elements are burn out, have plate members 35 (see FIG. 3) for lifting the granular raw materials.

In the drying section "A", the raw materials are lifted by the plate members 35 and thereafter fall, so that the raw materials are properly and efficiently dried by the heated air which is sent by the burner 16.

In the section in which the gas elements are removed by burning, the raw materials are properly mixed with air by the plate members 35, so that the raw materials can be uniformly burnt.

In the carbonizing section "B" in which the flame is small and the raw materials are carbonized, the raw materials need not be lifted. So no plate members are provided to the spiral members 34.

Next, an attaching mechanism of the inner cylindrical member 28 of the furnace proper 10 will be explained with reference to FIG. 3.

The inner cylindrical member 28 is divided, in the circumferential direction, into a plurality of divided pieces 38. Each divided piece 38 is formed into an arc piece. Namely, a plurality of arc-shaped divided pieces 38 are mutually connected to form the inner cylindrical member 28.

Each divided piece 38 has: an arc section 38*a*; and connecting sections 38*b* which are respectively provided at ends and which are capable of connecting with the connecting sections of the adjacent divided pieces 38.

The divided pieces 38 are mutually connected by pinching the connecting sections 38*b* of the adjacent divided pieces 38 with pinching sections 40*a* of fixed pieces 40. By mutually connecting the divided pieces 38 with the fixed pieces 40, the inner cylindrical member 28 is formed. In the present embodiment, each pinching section 40*a*, which is formed by bending a metallic plate, is fixed to the fixed pieces 40 by calking. A base section 40*b* of each fixed piece 40 is fixed on the inner circumferential face of the outer cylindrical member 30. With this structure, the inner cylindrical member 28, which is constituted by a plurality of the divided pieces 38, is held in the outer cylindrical member 30. The length of the fixed pieces 40 need not be equal to that of the inner cylindrical member 28. If the inner cylindrical member 28 can be constituted by the divided pieces 38 and can be held in the outer cylindrical member 30, the fixed pieces 40 may be partially and/or intermittently provided. Note that, the fixed pieces 40 also prevent the insulating layer 32 from moving.

Second Embodiment

Figure 4:
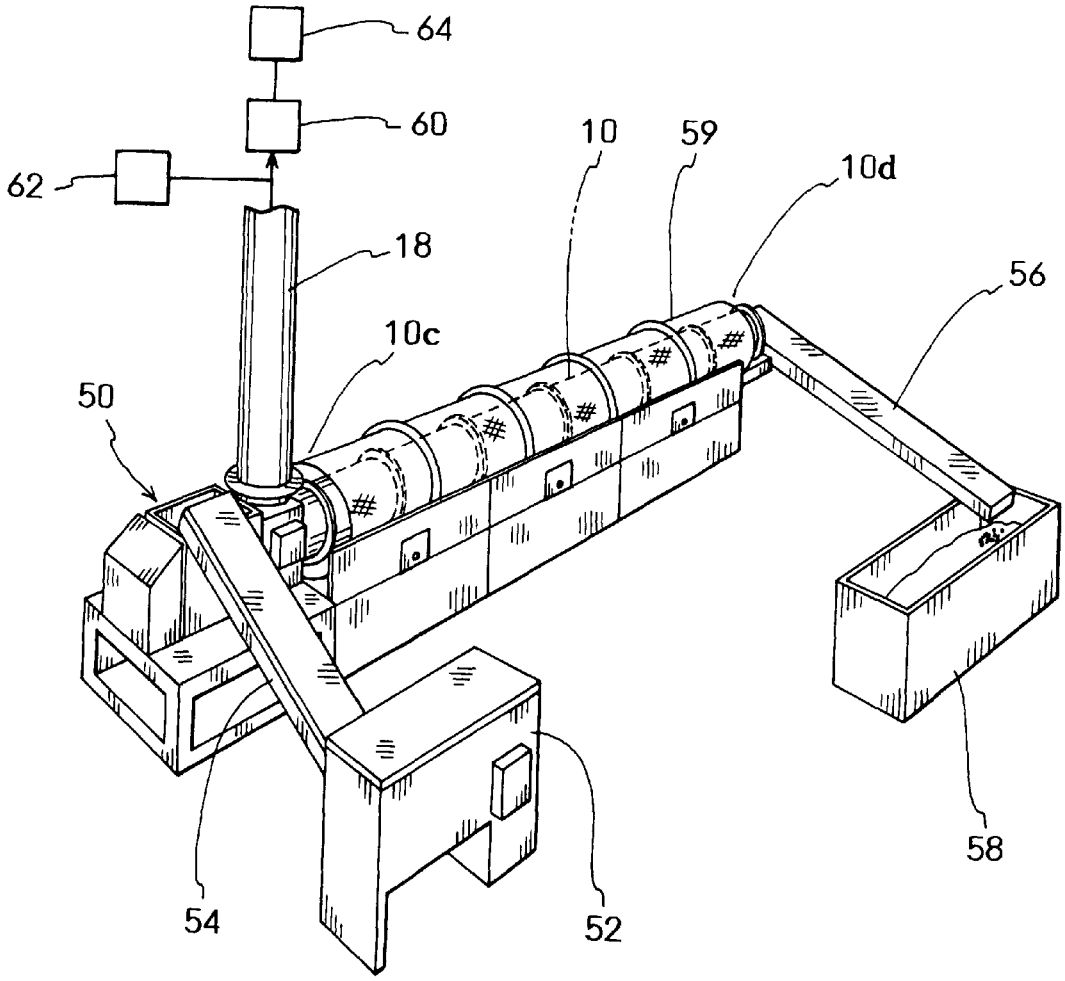
FIG. 4 is a perspective view of the carbonizing furnace of Second Embodiment of a the present invention.
Figure 5:
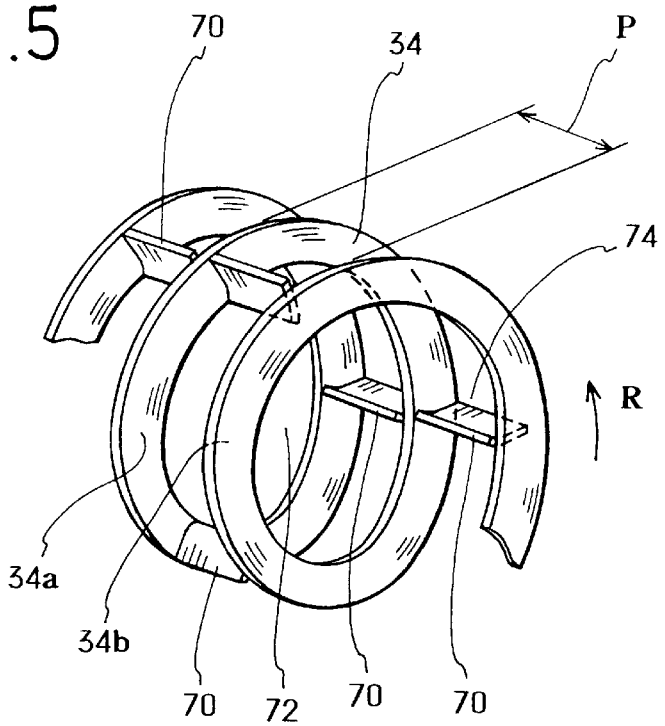
FIG. 5 is a perspective view of a part of a spiral-formed belt having plate members.
Figure 6:
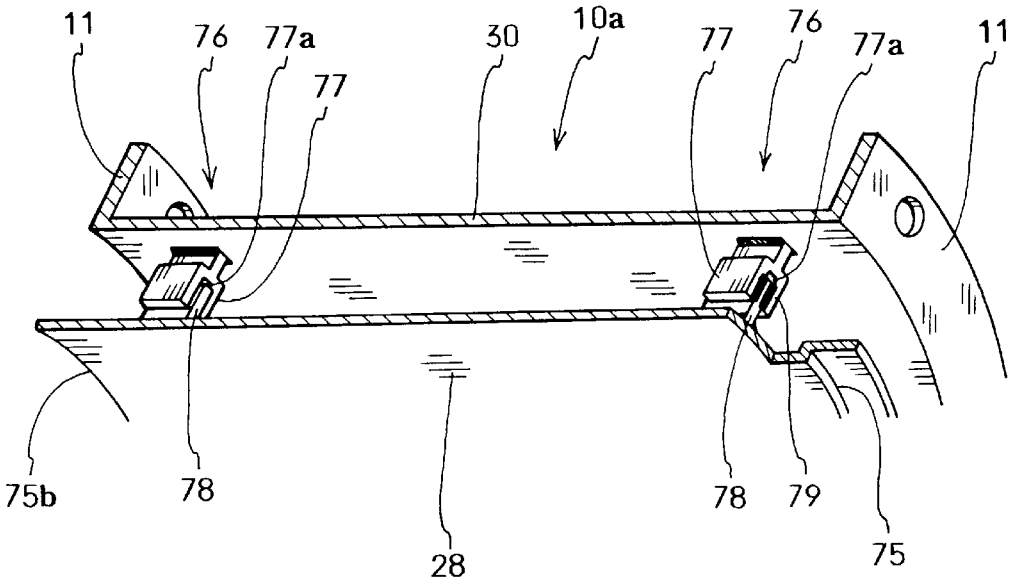
FIG. 6 is an explanation view showing an attaching mechanism of an inner cylindrical member.
Figure 7:
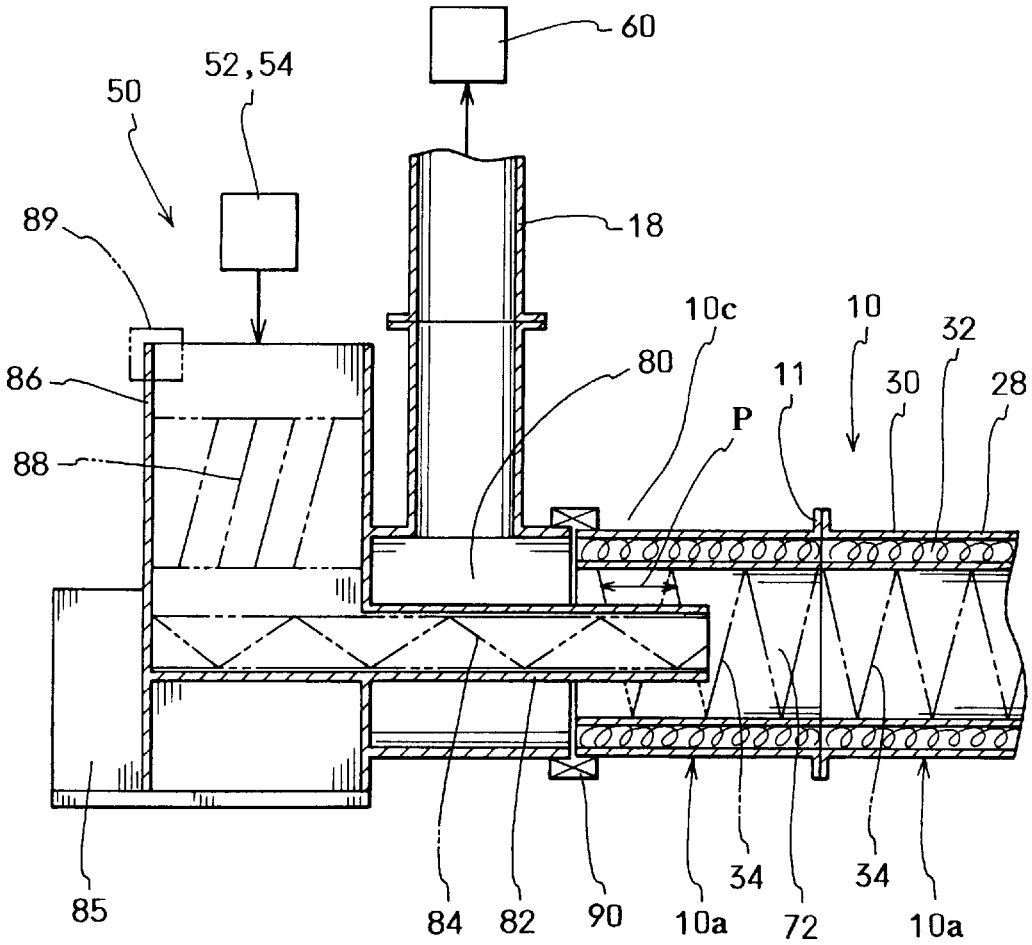
FIG. 7 is a sectional view in the vicinity of a material supplying mechanism and an exhaust chamber.

Second Embodiment will be explained with reference to FIGS. 4–7: FIG. 4 is a perspective view of the carbonizing furnace of the Second Embodiment; FIG. 5 is a perspective view of a part of the spiral member (the spiral-formed belt) 34; FIG. 6 is an explanation view showing an attaching mechanism, which holds the inner cylindrical member 28 in the outer cylindrical member 30; and FIG. 7 is a sectional view in the vicinity of a material supplying mechanism.

The basic structure of the Second Embodiment is the same as that of the First Embodiment, so the structural elements explained in the First Embodiments are assigned the same numeric symbols and detailed explanation will be omitted.

In FIG. 4, the material supplying mechanism 50, a device 52 for kneading the raw materials and a device 54 for feeding the raw materials are shown. In the kneading device 52, combustibles are kneaded with water, an inorganic binder and a water-soluble sugar so as to make the raw materials that will be carbonized. The kneaded raw materials are fed into the material supplying mechanism 50 by the feeding device 54.

The raw materials are supplied into the rotatable furnace proper 10 by the material supplying mechanism 50 and conveyed to the second end section 10*d* as well as the First Embodiment. Then, the carbides are discharged from the exit 14. The carbides discharged from the exit 14 are accommodated in a container 58 via a conveying path 56. Note that, a guard cover 59 covers over the furnace proper 10 for safety.

A sucking device 60 is provided in relationship to the chimney 18 so as to draw and exhaust the exhaust gas. By the sucking device 60, air can be properly passed through the furnace proper 10, so that carbonizing the raw materials can be accelerated and the exhaust gas can be securely exhausted.

A collecting device 62, which collects wood vinegar included in the exhaust gas, is provided in a gas discharging path, e.g., the chimney 18. The evaporated wood vinegar included in the exhaust gas is cooled and liquefied by the collecting device 62. To cool the heated exhaust gas, the collecting device 62 has a cooling unit, which has: cooling pipes through which cold water passes; and a collecting vessel in which the wood vinegar stuck on the cooling pipes is collected. By the collecting device 62, the wood vinegar can be efficiently collected.

An after burner 64 is provided to the sucking device 64 so as to purify the exhaust gas. Further, means for collecting ash may be provided.

Next, a concrete example of the spiral member 34 and plate members 70 will be explained with reference to FIG. 5.

To form a hollow conveying path 72 (see FIG. 7), which is extended in the axial line of the furnace proper 10, in the furnace proper 10, the spiral member (spiral-formed metallic belt) 34 is fixed on the inner circumferential face of the inner cylindrical member 28.

Each plate members 70 is fixed between each couple of faces 34*a* and 34*b* of the spiral member 34, which face each other in each pitch "P" of the spiral. The plate members 70 are provided relative to the spiral members 34 in the first end section 10*c*. The plate members 70 are arranged parallel to the axial line of the furnace proper 10, so that they can lift and agitate the raw materials with the rotation of the furnace proper 10.

Namely, the raw materials in spaces 74 are lifted upward and fallen when the furnace proper 10 is rotated in the direction "R". The raw materials lifted by the plate member 70 fall gradually, with the rotation, until reaching the uppermost position.

In the present embodiment, the plate members 70 are provided with angular separation of 120°, but the separation and the number of the plate members 70 may be optionally designed.

By lifting and dropping the raw materials, the raw materials can be properly dried and agitated, so that they can be properly burnt. About half of the raw materials in the space 74 fall backwardly, so the raw materials are conveyed or advanced half of the pitch "P" with one rotation of the furnace proper 10. All the raw materials can be conveyed with the continuous rotation of the furnace proper 10.

In the present embodiment, since about half of the raw materials in the space 74 fall backwardly, the conveying speed of the raw materials can be slower so that the length of the furnace proper 10 can be shorter. Therefore, the size of the carbonizing furnace can be small, and the carbonizing furnace can be installed in a narrower space.

As described above, the plate members 70 are provided on the first end section 10*c* side; no plate members are provided on the second end section 10*d* side. In the second end section 10*d*, all the raw materials are gathered on an inner bottom part of the furnace proper 10 and conveyed by the rotation of the spiral members 34. It is effective for drying the raw materials to agitate them; it is effective for carbonizing the raw materials to convey them without agitating.

The attaching mechanism of the inner cylindrical member 28 will be explained with reference to FIG. 6. Note that, FIG. 6 shows a part of the inner cylindrical member 28, the outer cylindrical member 30 and attaching means 76.

Holding members 77 are fixed to the outer cylindrical member 30. An outer end of the holding member 77 is fixed to the inner face of the outer cylindrical member 30 by welding; an inner end section of the holding member 77 is formed into a U-shaped having a groove 77*a*.

Connecting pieces 78 are fixed to the inner cylindrical member 28. An inner end of the connecting piece 78 is fixed on an outer circumferential face of the inner cylindrical member 28; an outer end section of the connecting piece 78 is inserted in the groove 77*a* of the holding member 77. In each sub-furnace member 10*a*, as shown in FIG. 6, a couple of the attaching means 76, each of which includes the holding member 77 and the connecting piece 78, are arranged in the axial direction of the sub-furnace member 10*a*, and four couples of the attaching means 76 are provided with angular separation of 90°.

As shown in FIG. 6, the holding member 77 and the connecting piece 78 of the right holding means 76 are fixed by welding 79; the holding member 77 and the connecting piece 78 of the left holding means 76 are slidably fitted relative to each other. With this structure, heat expansion of the inner cylindrical member 28, in the axial direction, can be allowed. By allowing the axial heat expansion of the inner cylindrical member 28, deformation of the furnace proper 10, which is caused by a difference in the rate of heat expansion between the inner cylindrical member 28 and the outer cylindrical member 30, can be prevented. Thus, the span of life of the furnace proper 10 can be improved.

A step section 75 is capable of fitting with a flat section 75*b* of the adjacent sub-furnace member 10*a*. The step section 75 also allows the heat expansion of the adjacent sub-furnace member 10*a*.

Note that, unlike the First Embodiment, the inner cylindrical member 28 of the Second Embodiment is not divided in the circumferential direction, so the structure of the present embodiment is simpler than that of the First Embodiment.

Next, the material supplying mechanism 50, which is provided in the vicinity of the entrance 12, and an exhaust chamber 80, to which the chimney 18 is connected, will be explained with reference to FIG. 7.

The material supplying mechanism 50 is connected with a pipe 82, whose diameter is shorter than inner diameter of the hollow conveying path 72. The material supplying mechanism 50 has: a hopper section 86 into which the raw materials are thrown; a spiral screw 84 for conveying the raw materials from the hopper section 86 to the furnace proper 10; an agitator 88 for agitating the raw materials; and a sensor 89 for detecting the amount of the raw materials in the hopper section 86. The pipe 82, in which the screw 84 is provided, is extended into the first sub-furnace member 10*a*. The screw 84 is rotated by a drive unit 85, which is located outside of the hopper section 86, to convey the raw materials into the furnace proper 10. The agitator 88 has, for example, a rotary shaft from which a plurality of agitating rods radially extend. The sensor 89 is electrically connected to the feeding device 54 (see FIG. 4), so the feeding device 54 is stopped to feed the raw materials into the hopper section 86 when the sensor 89 detects that the hopper section 86 is filled up with the raw materials.

In the present embodiment, the raw material is supplied to a position in the furnace proper 10, which is one pitch "P" or more inside from the left end of the spiral member 34. With this structure, all the raw materials can be conveyed forward even if some raw materials fall backwards from the plate members 70 while conveying.

Since the diameter of the pipe 82, in which the screw 84 is provided, is relatively short, the exhaust gas in the furnace proper 10 can be introduced outside, by the sucking device 60, via the exhaust chamber 80 and the chimney 18. The pipe 82 is filled with the raw materials, so no exhaust gas is leaked from the hopper section 86.

A sealing member 90, which is made of a heat-resisting material, e.g., silicone rubber, is capable of air-tightly sealing a gap between the exhaust chamber 80 and the left (first) end section 10*c* of the furnace proper 10, so that no exhaust gas is leaked from the gap even if the furnace proper 10 is rotated.

Successively, the action of the carbonizing furnace will be explained.

The raw materials are thrown into the entrance 12. In the First Embodiment, the raw materials are conveyed, in the furnace proper 10, toward the exit 14 by the rotation of the spiral members 34 and 34*c*. The spiral members 34 are rotated together with the furnace proper 10 when the motor 24 and the driving rollers 20 rotate the furnace proper 10. Firstly, the spiral member 34*a*, which is fixed to the sub-furnace member 10*a* located at the right end (see FIG. 1), is rotated, so that the raw materials supplied in a box 13 are conveyed forward. Similarly, the spiral members 34, which are respectively fixed to the sub-furnace members 10*a*, convey the raw materials forward with their rotation. The furnace proper 10 is separate away from the box 13, so the furnace proper 10 can be rotated. To prevent leakage of the raw materials from a gap between the furnace proper 10 and the box 13, the gap is covered with a cover 42.

On the other hand, in the Second Embodiment, the raw materials are supplied to the mid part in the sub-furnace member 10*a*, which is located at the left end (see FIG. 7), by the material supplying mechanism 50. Then the raw materials are conveyed by the spiral members 34 as well as the First Embodiment.

The raw materials are lit or burnt by the burner 16, which is provided to face the exit 14. Intensity of the flame of the burner 16 is adjusted so as to continuously burn and carbonize the raw materials. Usually, the gas elements included in the raw materials are self-burnt, so the burner 16 is used for only lighting the raw materials. In the conventional closed furnace, the burner must be driven for a long time. But the carbonizing furnace uses the burner 16 for only lighting the raw materials, so that fuel consumption can be quite improved.

The raw materials are burnt in the second end section 10*d* on the exit 14 side. Air heated by burning the raw materials is introduced to the sucking device 60, as heated wind, via the first end section 10*c* on the entrance 12 side, so the raw materials supplied into the first end section 10*c* can be efficiently dried. Energy consumption for drying the materials is also improved.

In the present embodiments, the combustibles of the raw materials are coated with the inorganic binder, e.g., bentonite, so oxidation is inhibited. By the inhibitory of the oxidation, the gas elements can be burnt but oxidation of carbon is inhibited. Thus, the carbides can be carbonized at relatively lower temperature: 700–850° C., so that the inner cylindrical member 28 may be made of stainless steel. As the inner cylindrical member 28 of the present embodiments, the stainless steel has enough durability.

The raw materials are carbonized, and the carbides are discharged from the exit 14. The discharged carbides are rapidly cooled, and the flame is rapidly stifled, so the granular carbides can be efficiently made. By the carbonizing furnace, ceramic balls including the carbides can be produced (incinerated) by the same manner.

Conveying speed of the raw materials can be controlled by adjusting rotational speed of the motor 24. Standard conveying speed is about 1 m/min. In the case of carbonizing dried materials, e.g., rice hulls, they may be conveyed at higher speed; in the case of carbonizing wet materials, e.g., coffee grounds, they should be conveyed at a lower speed.

Successively, the raw materials will be explained.

In the carbonizing furnace of the present embodiments, the raw materials, which are combustibles or include combustibles and whose surfaces are coated with the inorganic binder, e.g., bentonite, can be effectively carbonized. Especially, the raw materials, whose surfaces are coated with a layer made from the inorganic binder and a water-soluble sugar, can be further effectively carbonized.

The carbonizing furnace is capable of effectively carbonizing a mixture of the granular raw materials, which are combustibles or include combustibles and whose surfaces are coated with the inorganic binder, and inorganic aggregates. And, the carbonizing furnace is capable of effectively carbonizing a mixture of the granular raw materials, which are combustibles or include combustibles and whose surfaces are coated with the layer made of the inorganic binder and the water-soluble sugar, and the inorganic aggregates.

In the present embodiments, the word "combustibles" includes: coal; wood; bamboo; plastics; rice hulls; buckwheat chaff; grains; foods; kitchen refuse; industrial waste, etc. Namely, the word means all solid bodies which can be burnt. Especially, grain wastes, e.g., grounds of coffee, rice hulls, sawdust, grain powders, are preferable.

The raw materials may include the combustibles and incombustibles. In this case, the word "incombustibles" includes: glass; ceramics; water, etc.

Ceramic clay, e.g., fire-resisting ceramic clay, bentonite, may be employed as the inorganic binder. Especially, the bentonite can highly inhibit the oxidation of the combustibles.

Oligosaccharides and monosaccharides, e.g., cane sugar, malt sugar, grape sugar, may be employed as the water-soluble sugar.

Grains of inorganic waste may be employed as the inorganic aggregates. Casting sand, mud, grains or powders of bricks, blast furnace slag, foundry slag, perlite, glass fibers, rock wool, waste ceramic clay, ash in a furnace, rust of metal, etc. also may be employed as the inorganic aggregates.

Methods of coating the raw materials with the inorganic binder will be explained. For example, in the case of the coffee grounds which include water, enough binder layer can be formed by merely kneading the coffee grounds with the binder without adding water. On the other hand, in the case of the rice hulls which include no water, enough binder layer can be formed by merely kneading the rice hull with the binder and water. Namely, the raw materials and the binder are kneaded with water. In the present invention, the thin binder layer effectively inhibits the oxidation of the raw materials.

The water-soluble sugar may be dissolved in the water before kneading. If enough water is included in the raw materials, powders of the water-soluble sugar may be kneaded with the raw materials and the inorganic binder.

The present invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A carbonizing furnace, comprising:

a furnace proper being formed into a cylindrical shape, said furnace proper having a first end section, to which a combustible raw material is supplied, and a second end section, from which a carbide is discharged;

means for conveying the raw material from the first end section to the second end thereof;

said conveying means includes a rotating mechanism for rotating said furnace proper about an axial line and a spiral member being provided in said furnace proper, said spiral member being capable of conveying the raw material from the first end section to the second end section, said spiral member being a spiral-formed belt which is fixed on an inner circumferential face of said furnace proper whereby a hollow conveying path extending in the axial line of said furnace proper is formed in said furnace proper;

lifting means for lifting the raw material being provided between each couple of faces of said spiral-formed belt, which face each other in each pitch of the spiral, in the first end section of said furnace proper; and means for burning the raw material to make the carbide, said burning means burning the raw material in the second end section whereby the raw material is carbonized therein;

wherein a surface of the raw material is coated with an inorganic binder.

2. The carbonizing furnace according to claim 1, wherein said burning means is a burner, which is provided in the second end section and capable of throwing a flame into the second end section of said furnace proper toward the first end section thereof.

3. The carbonizing furnace according to claim 1, wherein said furnace proper is formed by connecting a plurality of sub-furnace members in the axial direction of said furnace proper.

4. The carbonizing furnace according to claim 1, wherein said furnace proper comprises:

a metallic inner cylindrical member;

a metallic outer cylindrical member whose diameter is greater than that of said inner cylindrical member, said outer cylindrical member being coaxially provided outside of said inner cylindrical member; and a heat insulating layer being formed between said inner cylindrical member and said outer cylindrical member.

5. The carbonizing furnace according to claim 4, wherein one end of said inner cylindrical member is fixed to said outer cylindrical member, the other end of said inner cylindrical member is not fixed whereby heat expansion of said inner cylindrical member is allowed.

6. The carbonizing furnace according to claim 1, wherein said lifting means is a plate member provided parallel to the axial line of said furnace proper.

7. The carbonizing furnace according to claim 6, wherein the raw material is supplied to a position in the furnace proper, which is one pitch or more inside from an end of said spiral-formed belt.

8. The carbonizing furnace according to claim 1, further comprising means for sucking gas, which is generated when the raw material is carbonized.

9. The carbonizing furnace according to claim 1, further comprising:

a gas discharging path through which gas, which is generated when the raw material is carbonized, is discharged; and means for collecting a wood vinegar, said collecting means being provided in said gas discharging path, said collecting means being capable of cooling wood vinegar evaporated from said gas to collect the wood vinegar as liquid.

10. A carbonizing furnace, comprising:

a furnace proper being formed into a cylindrical shape, said furnace proper having a first end section, to which a combustible raw material is supplied, and a second end section, from which a carbide is discharged;

means for conveying the raw material from the first end section to the second end thereof;

means for burning the raw material to make the carbide, said burning means burning the raw material in the second end section whereby the raw material is carbonized therein;

a gas discharging path through which gas, which is generated when the raw material is carbonized, is discharged; and means for collecting a wood vinegar, said collecting means being provided in said gas discharging path, said collecting means being capable of cooling wood vinegar evaporated from said gas to collect the wood vinegar as liquid;

wherein a surface of the raw material is coated with an inorganic binder.

11. The carbonizing furnace according to claim 10, wherein said conveying means includes:

a rotating mechanism for rotating said furnace proper about its axial line; and a spiral member being provided in said furnace proper, said spiral member being capable of conveying the raw material from the first end section to the second end section.

12. The carbonizing furnace according to claim 11, wherein said spiral member is a spiral-formed belt which is fixed on an inner circumferential face of said furnace proper whereby a hollow conveying path extending in the axial line of said furnace proper is formed in said furnace proper; and lifting means for lifting the raw material being provided between each couple of faces of said spiral-formed belt, which face each other in each pitch of the spiral, in the first end section of said furnace proper.

13. The carbonizing furnace according to claim 12, wherein said lifting means is a plate member provided parallel to the axial line of said furnace proper.

14. The carbonizing furnace according to claim 13, wherein the raw material is supplied to a position in the furnace proper, which is one pitch or more inside from an end of said spiral-formed belt.

15. The carbonizing furnace according to claim 10, wherein said burning means is a burner, which is provided in the second end section and capable of throwing a flame into the second end section of said furnace proper toward the first end section thereof.

16. The carbonizing furnace according to claim 10, wherein said furnace proper is formed by connecting a plurality of sub-furnace members in the axial direction of said furnace proper.

17. The carbonizing furnace according to claim 10, wherein said furnace proper comprises:

a metallic inner cylindrical member;

a metallic outer cylindrical member whose diameter is greater than that of said inner cylindrical member, said outer cylindrical member being coaxially provided outside of said inner cylindrical member; and a heat insulating layer being formed between said inner cylindrical member and said outer cylindrical member.

18. The carbonizing furnace according to claim 17, wherein one end of said inner cylindrical member is fixed to said outer cylindrical member, the other end of said inner cylindrical member is not fixed whereby heat expansion of said inner cylindrical member is allowed.

19. The carbonizing furnace according to claim 10, further comprising means for sucking gas, which is generated when the raw material is carbonized.

* * * * *